US005704151A

United States Patent [19]

West et al.

[11] Patent Number: 5,704,151

[45] Date of Patent: Jan. 6, 1998

[54] PORTABLE BATTERY-POWERED SAFETY LOCK

[75] Inventors: James Paul West, 3232 NW. 16 Ave., Gainesville, Fla. 32605; John Kirk, Gainesville, Fla.; James F. Kirk, Newberry, Fla.

[73] Assignee: James Paul West, Gainesville, Fla.

[21] Appl. No.: 410,468

[22] Filed: Mar. 24, 1995

[51] Int. Cl.[6] ..... F41A 17/06; F41A 17/54

[52] U.S. Cl. ..... 42/70.07; 42/70.11

[58] Field of Search ..... 42/70.11, 70.07

[56] References Cited

U.S. PATENT DOCUMENTS

| | | | |
|---|---|---|---|
| 5,022,175 | 6/1991 | Oncke et al. | 42/70.11 |
| 5,193,201 | 3/1993 | Tymes | 395/800 |
| 5,283,971 | 2/1994 | Fuller et al. | 42/70.07 |
| 5,303,495 | 4/1994 | Harthcock | 42/84 |
| 5,392,552 | 2/1995 | McCarthy et al. | 42/70.07 |
| 5,419,068 | 5/1995 | Pages et al. | 42/70.07 |
| 5,487,234 | 1/1996 | Dragon | 42/70.07 |
| 5,583,486 | 12/1996 | Kergten | 340/568 |

*Primary Examiner*—Stephen M. Johnson

*Attorney, Agent, or Firm*—Saliwanchik, Lloyd & Saliwanchik

[57] ABSTRACT

The present invention relates to a safety lock that is attachable to the trigger of firearms to prevent accidental or unauthorized discharge. The safety lock comprises a pair of opposed plates, one having one or more pins extending normal therefrom, the other having a set of complementary pin-receiving orifices and housing a locking mechanism. The locking mechanism is controlled by a battery-powered microprocessor which not only receives and analyzes signals from a keypad, but detects unauthorized signals, controls deactivation of the keypad for preset period of time upon the detection of unauthorized user or improper code input, controls an audio alarm signal of the keypad by an unauthorized user, controls a low-battery warning signal, allows the authorized user to change the authorized signal, provides a method for disabling the locking system other than through the user determined code input at the keypad, monitors, controls, and provides for a low-battery voltage drain; and illuminates the keypad upon activation of the safety lock.

21 Claims, 8 Drawing Sheets

PORTABLE BATTERY-POWERED SAFETY LOCK

FIELD OF THE INVENTION

The present invention relates to battery-powered, microprocessor-controlled, portable coded safety locks; more particularly to portable coded safety locks for firearms; and most particularly to portable coded safety locks which prevent firearm trigger movement.

BACKGROUND OF THE INVENTION

Incidents relating to the inadvertent firing of firearms are numerous. Frequently, firearms are discharged while being cleaned or while being used as playthings by children. In addition, firearms are common objects of theft which are subsequently used in the commission of crimes. Because of these types of inadvertent or unauthorized use of firearms, there is a need for a safety lock which will effectively inhibit the discharge of firearms.

Firearms are commonly kept as weapons for self-defense to be used in emergency situations. Often their use in such situations requires that they be able to be fired with very little warning or lead time. Accordingly, a safety lock which inhibits the inadvertent or unauthorized discharge of a firearm should ideally be easily and quickly released to permit emergency use of the firearm in circumstances where there is little advance warning.

Safety locks for preventing inadvertent or unauthorized discharge of firearms are well-known, and there are numerous prior art documents disclosing both mechanical and electro-mechanical safety devices. Each of those specifically identified below is hereby incorporated herein by reference in its entirety. U.S. Pat. No. 4,141,166, issued to Schultz, discloses a safety mechanism for sensing the engagement of a rifle butt with an operator's shoulder and for sensing engagement of the operator's hand with the firearm stock. The sensing switch energizes a solenoid which thereupon removes an interposed mechanical member. U.S. Pat. No. 4,457,091, issued to Wallerstein, discloses an electronic push-button safety lock mechanism. Each of the foregoing references, however, discloses safety locks which are integral parts of the firearm, and as such, are not portable or transferrable from one firearm to another. Portable trigger locks which are purely mechanical are depicted in U.S. Pat. No. 3,956,842, issued to Ballenger, and U.S. Pat. No. 5,050,328, issued to Insko, for example. However, such trigger locks often require tools or keys for attachment and removal, or can otherwise be cumbersome to remove under emergency circumstances, thereby unnecessarily endangering the welfare of the firearm user under emergency self-defense conditions. Additionally, such locks can be removed by unauthorized users.

Accordingly, it is clear that there is a need for a portable, effective, easily-actuated, and easily-removable safety lock which cannot be removed by an unauthorized user. In particular, what is needed is a safety lock which can be installed on various firearms, without the use of a tool or key, that securely prevents movement of the trigger to prevent accidental or unauthorized firing of the weapon, and yet is quickly and easily removable.

SUMMARY OF THE INVENTION

According to the invention, there is provided a completely portable, easily-removable, self-contained, and universal-fitting trigger lock for a firearm whereby the firearm may be securely prevented from accidental or unauthorized discharge, and may quickly be made available for discharge, by activation or deactivation of a trigger lock comprising a pair of opposed plates, one comprising at least one pin extending from the inward-facing side of the plate, the other plate comprising at least one complementary pin-receiving orifice, such that when the plates are properly mounted, the pin from one plate extends through the pin-receiving orifice of the other where it is engaged by a locking means that cannot be released by an unauthorized user. In a preferred embodiment, the plate comprising the pin-receiving orifice has a keypad on the external surface thereof, and a microprocessor mounted therein to receive and analyze signals sent by manipulation of the keypad. Alternatively, the keypad may be located on the opposite plate and can transmit the authorization signal therefrom. The locking means is released by an authorized user entering a predetermined code through use of a keypad which sends signals to a battery-powered microprocessor mounted inside of that plate. In alternative embodiments, the keypad may be replaced by any other device through which authorization information can be received and transferred for analysis and processing. Such devices include, but are not limited to, fingerprint or voice recognition systems, and other such devices which are well-known in the art.

In the most preferred embodiment, the trigger lock comprises a keypad having at least four buttons, however, the skilled artisan would easily understand that the number of buttons could be increased or decreased without altering the function of the invention. Further, while in the most preferred embodiment the code is signalled by the sequence in which the buttons are pressed by the user, it is obvious that the duration of button depression could be used to signal the code as well, for example, by a Morse-type code.

The most preferred embodiment also comprises a tampering sensor of a type well known in the art which detects excessive vibration or shock, and a sensor that can also detect force acting against the locking means such as would be created by an unauthorized user attempting to pry or force the engaged plates apart. Upon detection of such tampering, the sensor transmits a signal to the microprocessor, which in turn controls an appropriate response, either a visual and/or audible signal, or a shutdown of the lock, or both.

The microprocessor of the subject invention, in the most preferred embodiment, controls deactivation of the locking means by analyzing a signal received from a code input at the keypad, and distinguishes between authorized and unauthorized signals; maintains activation of the locking mechanism and deactivates the keypad for a pre-set period of time upon the detection of an unauthorized user or improper code input; controls an audio alarm signal upon the use of the keypad by an unauthorized user; controls a low battery warning signal; enables a method for disabling the locking system other than through the user predetermined code input at the keypad; monitors, controls, and provides for a low rate of battery voltage drain; allows and controls the processing for authorized user setting of predetermined user codes; illuminates the keypad upon activation of the safety lock apparatus; and controls illumination of LEDs which indicate tampering, unauthorized or authorized code entry, and low battery power of the lock.

In a preferred embodiment, at least one of the trigger lock plates also comprises a spring, which is biased such that when the plates are in the locked position the spring is compressed either between said plate and a portion of the firearm, or between the inward-facing surfaces of each plate, or, in a particularly preferred embodiment, between a portion of the pin and the closed back of the pin-receiving orifice. In an alternative preferred embodiment the spring is biased between a portion of the pin proximal to where it extends from its plate and a portion of the inward-facing surface of the other plate. In this manner, when the locking mechanism is released by an authorized user entering the proper code, the force of the compressed spring propels the plates of the trigger lock apart and away from the firearm.

An alternative means for providing the expulsive force that propels the plates apart upon entry of an authorized code is via magnetic fields. For example, in the locked configuration of one embodiment of the subject invention, a magnetic field is generated in each of the frontplate and backplate whereby the inward-facing surface of the backplate is given a polarity complementary to that of the inward-facing surface of the frontplate such that there is a magnetic attraction between them. Then, upon entry of an authorized code, the polarity of one of the inward-facing surfaces is reversed, resulting in expulsive force from the magnetic repulsion between the inward-facing surfaces.

Advantageously, an embodiment of the subject invention is a portable lock controlled by a microprocessor that operates at less than 3 volts. There is no disclosure in the art of any battery-powered microprocessor-controlled portable lock that operates at such low voltage, and its use can extend far beyond trigger locks, as will be obvious to those skilled in the art.

Thus, the subject invention provides a firearm safety lock which is compact, portable, programmable so as to be operable only by an authorized user, and which is quickly and easily removed from a firearm upon entry of the proper code.

BRIEF DESCRIPTION OF THE DRAWINGS

Further objects and advantages of the present invention will become apparent from the following detailed description of an illustrative embodiment, taken in conjunction with the following drawings.

DETAILED DESCRIPTION OF THE PREFERRED EMBODIMENTS

Figure 1:
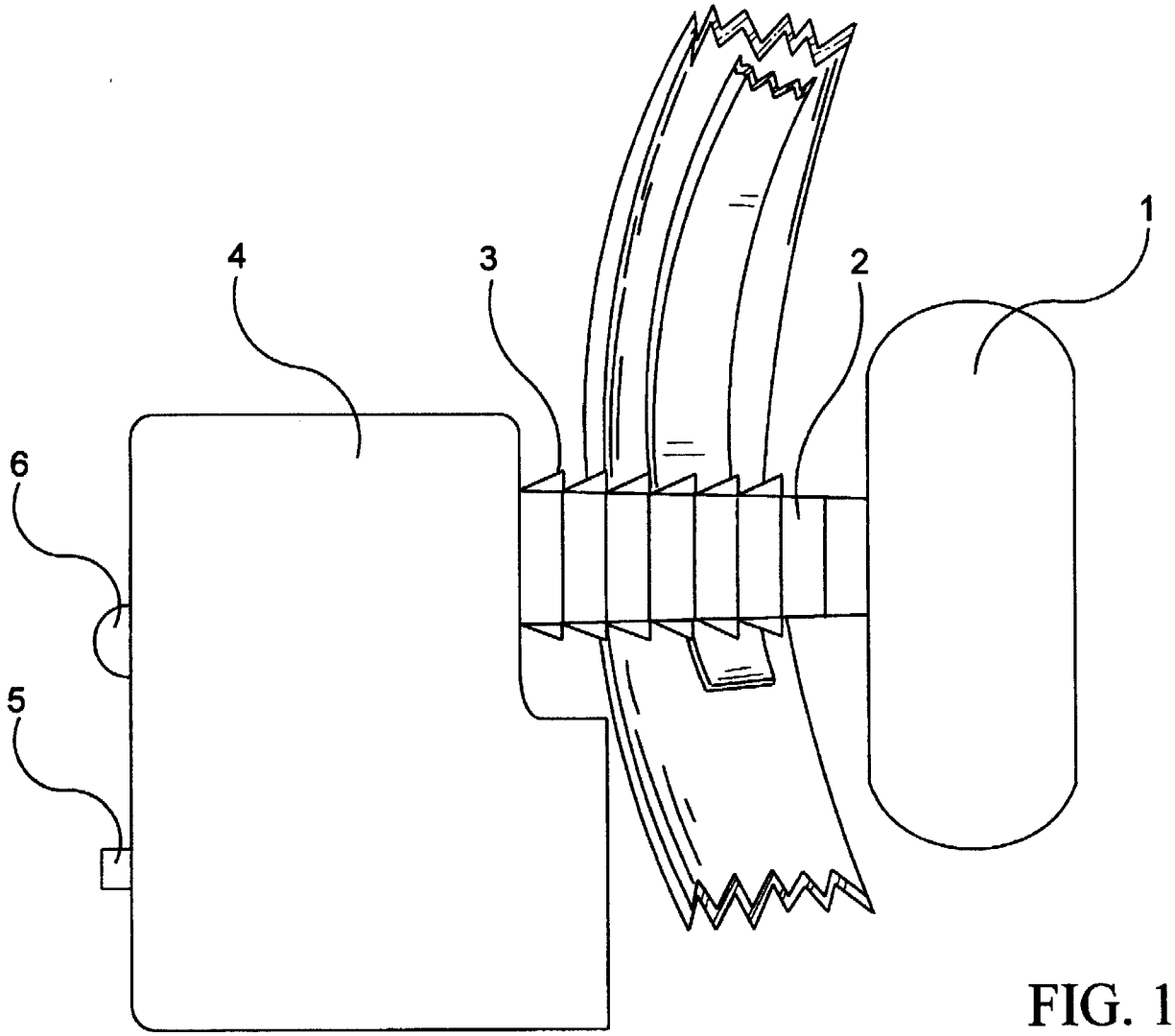
FIG. 1 is a side-view of an embodiment of the subject invention showing the trigger lock plates in a joined configuration.
Figure 2:
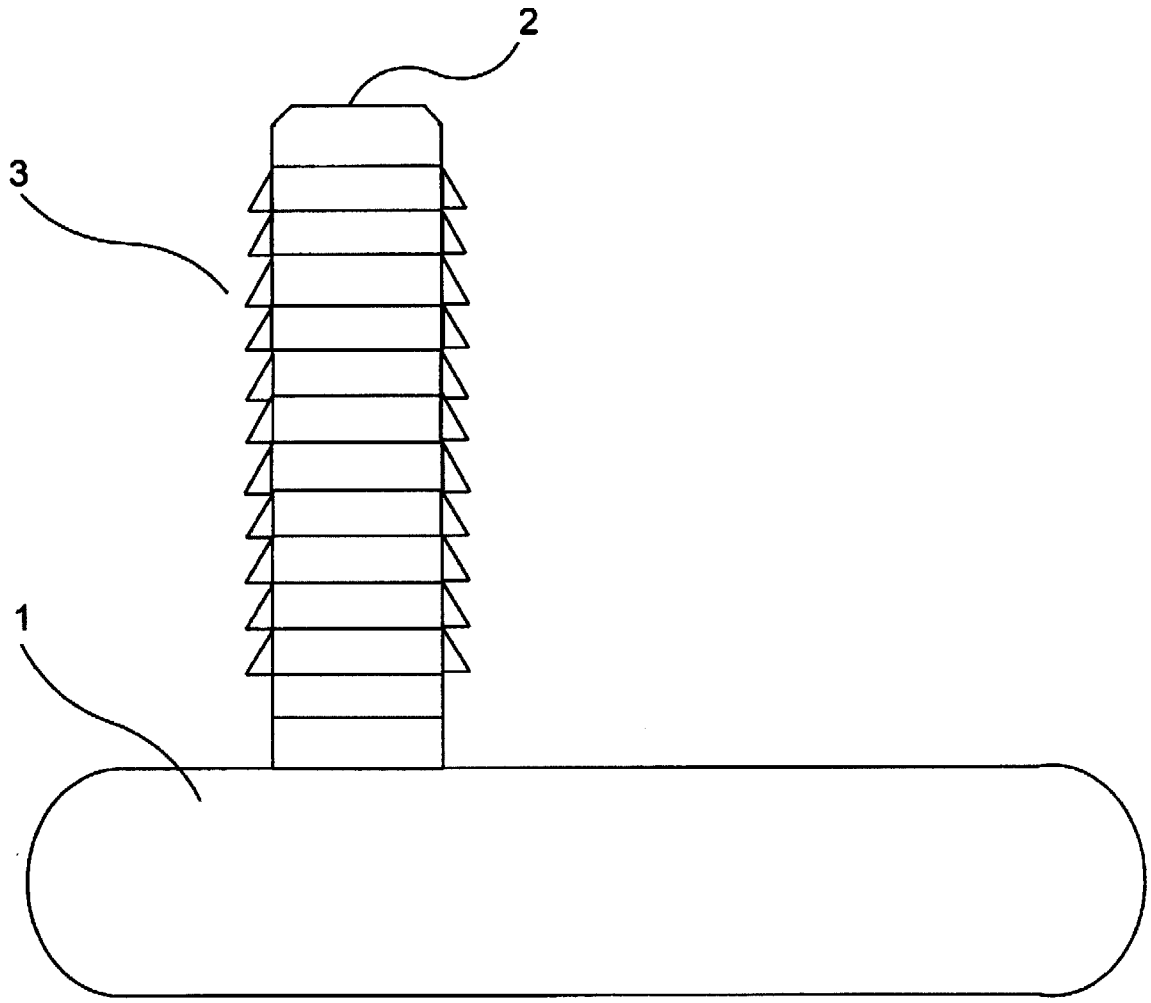
FIG. 2 is a rear elevation of a preferred embodiment of the trigger lock backplate.
Figure 3:
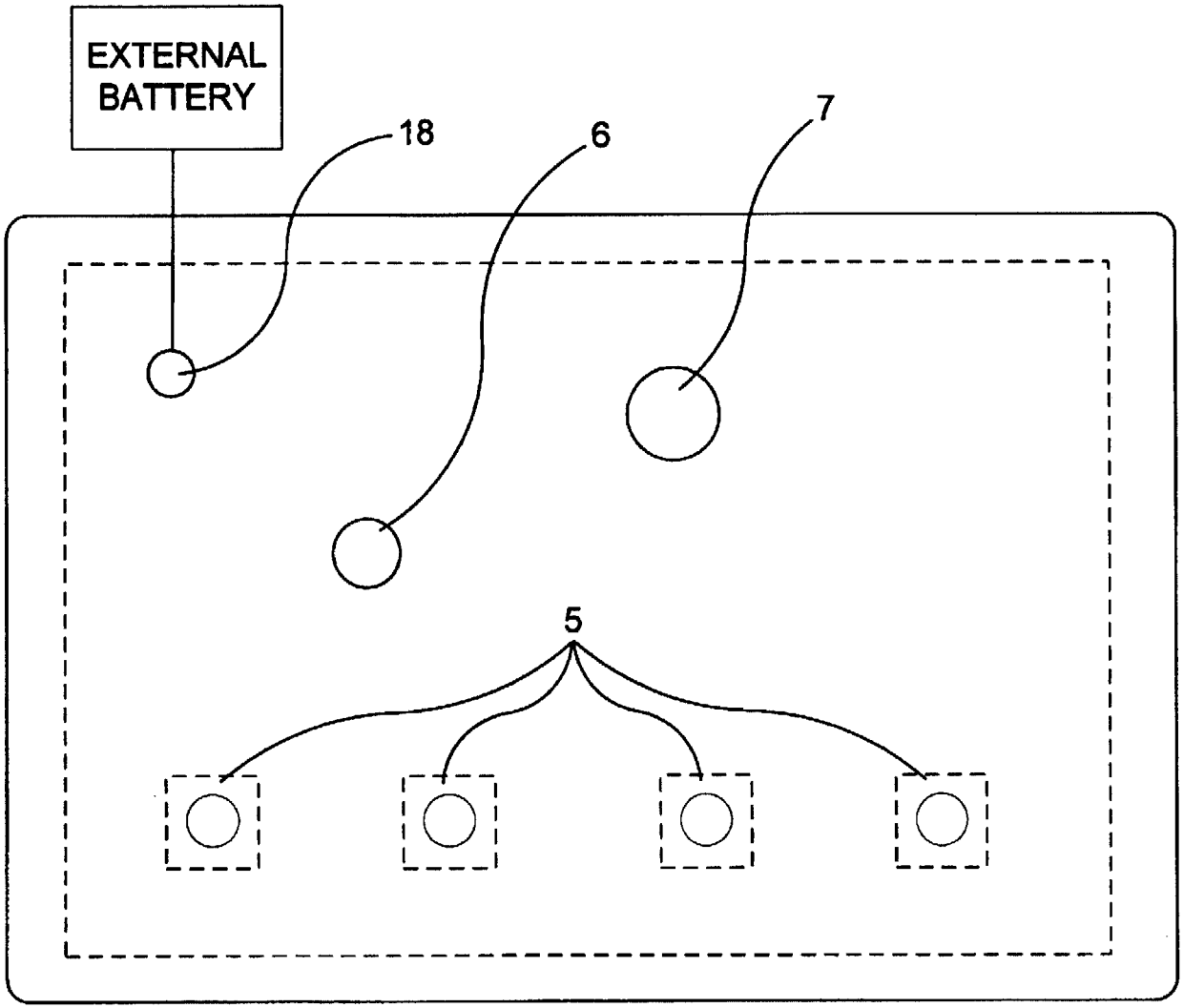
FIG. 3 is a front view of a preferred embodiment of the trigger lock frontplate.
Figure 4:
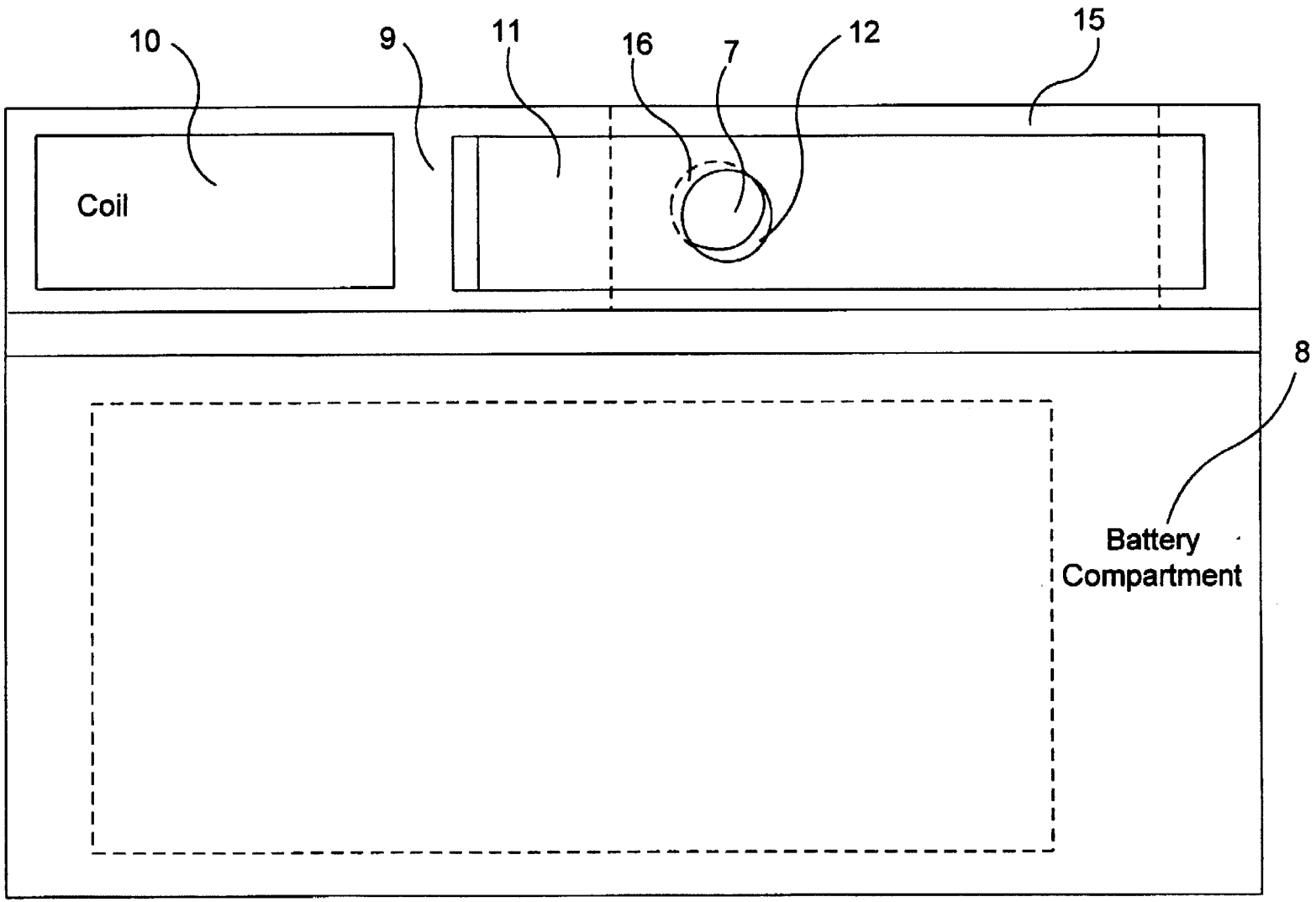
FIG. 4 is a cross-sectional view showing the internal layout of the frontplate of the trigger lock embodiment depicted in FIG. 3.
Figure 5:
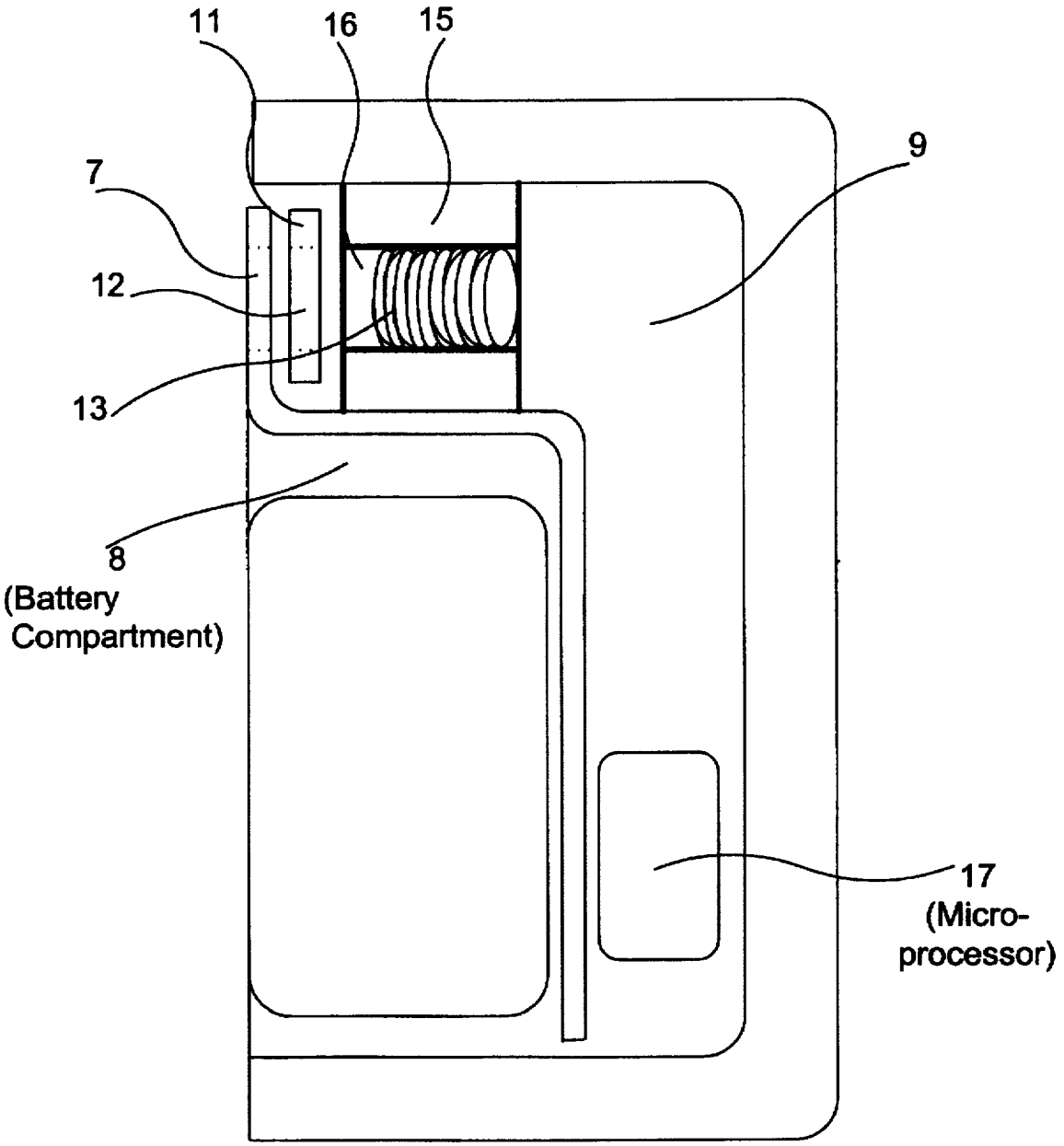
FIG. 5 is a cross-sectional side-view of the trigger lock frontplate depicted in FIGS. 3 and 4.
Figure 6:
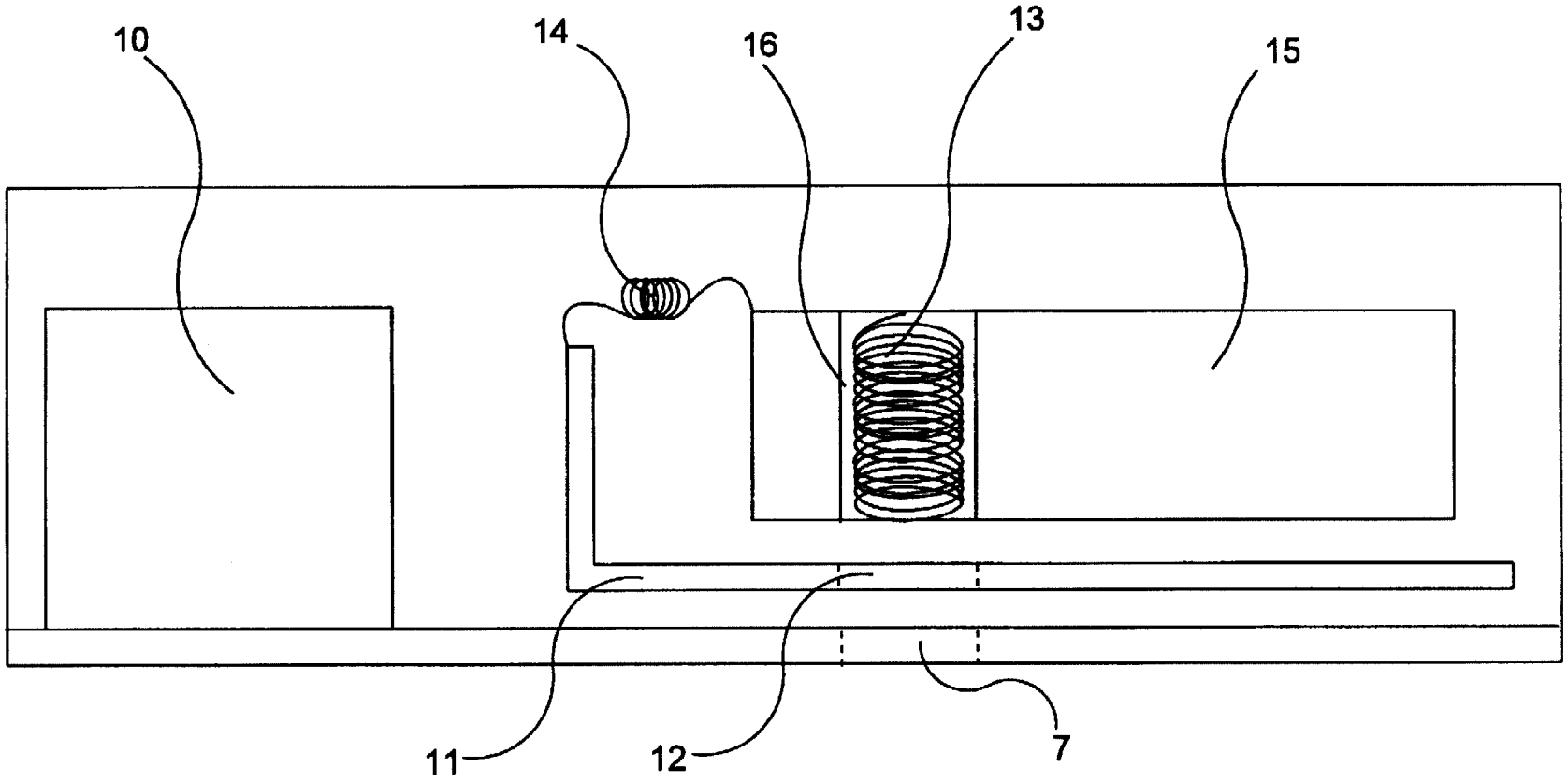
FIG. 6 is a cross-sectional top-view of the trigger lock front plate depicted in FIGS. 3, 4, and 5.

Reference is now made to the drawings in which like numerals represent like elements throughout the several views. The safety lock of the subject invention is designed to be used with any type of firearm that .operates with a standard trigger mechanism. Referring to FIG. 1, a preferred embodiment of the subject invention is depicted in which backplate 1 and frontplate 4 have been engaged such that the configuration is that of the safety lock when in use. In a preferred embodiment, there is a pin 2 extending normal from the inward face of backplate 1. In operation, pin 2 is inserted through the trigger guard of the firearm and into the complementary pin-receiving orifice 7 of frontplate 4. Alternatively, there may be a plurality of pins on one plate and a complementary plurality of pin-receiving orifices on the other, strategically placed to receive the pins. Pin-receiving orifice 7 opens on the inward-facing surface of frontplate 4, and in a preferred embodiment extends partially through frontplate 4 such that it is of sufficient depth to receive pin 2, but has a closed end such that the orifice does not extend completely through frontplate 4. In an alternative embodiment, pin-receiving orifice 7 may extend completely through the frontplate 4 such that it opens on the outward-facing surface of frontplate 4 as is more clearly depicted in FIG. 3. In the preferred embodiment depicted in FIGS. 4, 5, and 6 frontplate 4 comprises a catch-plate compartment 9, in which catch-plate 11 is slidably disposed. Catch-plate compartment 9 also houses, in a preferred embodiment, a pin holding block 15, which itself comprises at least one pin-receiving chamber 16 which is in alignment with pin-receiving orifice 7. Catch-plate 11 comprises at least one pin aperture 12, which is defined by a rim of catch-plate 11 and which extends therethrough. Pin aperture 12 is strategically located on catch-plate 11 such that when catch-plate 11 is in its resting configuration, pin aperture 12 is slightly out of alignment with pin-receiving orifice 7. This resting orientation is accomplished, in a preferred embodiment, by the bias of catch-plate retaining spring 14 which is strategically attached at one end to pin holding block 15 and at the other end to catch-plate 11. As described herein, this purposeful misalignment leads to a, reliable locking mechanism for the subject invention. In operation, as pin 2 i..s inserted through pin-receiving orifice 7, pin 2 encounters the slightly misaligned pin aperture 12,, and as pin 2 is forced therethrough, catch-plate 11 is displaced, aligning pin aperture 12 with pin-receiving orifice 7 sufficiently to allow pin 2 to pass therethrough and into pin-receiving chamber 16. Pin 2 preferably comprises a plurality of serations or teeth 3 which are configured such that as pin 2 is inserted through pin-receiving orifice 7 the sloped surfaces of teeth 3 encounter the rim of catch-plate 11 which defines pin aperture 12, and as pin 2 is forced through pin aperture 12, the rim of catch-plate 11 rides up the sloped surface of each tooth, displacing catch-plate 11 and then allowing catch-plate 11 to fall back towards its original resting position after riding up the incline of each tooth. As will be easily understood by one skilled in the art, once pin 2 has been pushed through pin aperture 12 as far as is desired by the user, the bias of catch-plate 11 towards its resting position causes the rim of catch-plate 11 to press against teeth 3 in a manner which prevents the retraction of pin 2 from pin aperture 12, until catch-plate 11 is purposely displaced sufficiently to realign pin aperture 12 with pin-receiving orifice 7, thereby disengaging from teeth 3 and permitting withdrawal of pin 2 from pin-receiving orifice 7, resulting in separation of backplate 1 from frontplate 4.

In an alternative embodiment, pin 2 is smooth, and does not comprise any serations or teeth. In this embodiment, catch-plate 11 is preferably angled such that the bias of catch-plate 11 towards its resting position causes the rim of catch-plate 11 to press against the external surface of pin 2 in a manner which results in a frictional engagement sufficient to prevent unauthorized withdrawal of pin 2 from pin-receiving orifice 7. Other locking mechanisms which could replace catch-plate 11 are well-known in the art, such as a cantilever strategically placed inside frontplate 4 such that upon insertion of pin 2 into pin-receiving orifice 7, the pin displaces and engages the cantilever, which engagement results in a frictional force sufficient to prevent withdrawal of the pin from the orifice. Alternatively, if the pin comprises teeth, the cantilever can be biased to engage such teeth in a manner similar to that described for catch-plate 11 in connection with the description of the most preferred embodiment above.

Yet another type of locking mechanism which could be substituted in an alternative embodiment is one wherein the microprocessor controls generation of an intense magnetic field having sufficient force to maintain the pin in secured engagement with the pin-receiving orifice to inhibit removal of the safety lock until entry of an authorized signal, which would then result in deactivation of the magnetic force and thereby permit withdrawal of the pin from the pin-receiving orifice. A wide variety of alternative locking mechanisms are well-known to those skilled in the art, and are easily understood to be interchangeable with those specifically described herein.

In the preferred embodiment, catch-plate 11 is constructed of a metallic compound susceptible to magnetic forces. Purposeful displacement of catch-plate 11 is accomplished by activation of a coil 10, which is strategically mounted in catch-plate compartment 9 of frontplate 4 such that a sufficient magnetic force can be exerted by coil 10 on catch-plate 11 to overcome the bias of catch-plate retaining spring 14 and displace catch-plate 11 sufficiently to align pin aperture 12 with pin-receiving orifice 7. Frontplate 4 also comprises a battery compartment 8, wherein a battery can be housed which provides the power to activate coil 10. Activation of coil 10 is controlled by a microprocessor 17 housed proximal to battery compartment 8, which also monitors and controls battery voltage drain. In the preferred embodiment, an authorized user causes activation of the coil by entering a code, preferably by pressing a plurality of buttons, for example on a keypad 5, in a predetermined sequence, which sends a signal to the microprocessor. The microprocessor then analyzes the signal which, if determined to be the proper one, causes the microprocessor to activate the coil.

As an alternative to the catch-plate retaining spring 14, a magnet could be strategically located to ensure that catch-plate 11 is sufficiently misaligned in its resting position. In this embodiment, upon activation, the coil 10 would exert a magnetic force stronger than that of the magnet thereby displacing catch-plate 11 sufficiently to align pin aperture 12 with pin-receiving orifice 7.

In the most preferred embodiment, frontplate 4 also comprises at least one light-emitting diode 6, which can act as an indicator of such situations as low battery power, improper code entry, authorized code entry, or tampering. Optionally, in the alternative or in addition to the light-emitting diode 6, the subject safety lock can also comprise a miniature sound-emitting device of a type well-known in the art which can give an audible indication of low battery power, improper code entry, tampering, or the like. To allow activation or deactivation of the locking mechanism in circumstances where the internal battery power is insufficient for activation or deactivation of the system, an external contact surface 18 can be provided on either frontplate 4 or backplate 1 which allows a user to use a new battery externally to apply sufficient current for activation or deactivation of the locking mechanism until the internal battery is replaced.

In the most preferred embodiment, frontplate 4 further comprises an expulsion spring 13, mounted inside pin-receiving chamber 16 and biased such that it is in a relaxed position until backplate 1 and frontplate 4 are moved towards each other in the process of securing the subject safety lock to a firearm. As they are moved towards each other and pin 2 enters pin-receiving chamber 16, spring 13 encounters the tip of pin 2 and is compressed as pin 2 is pushed deeper into chamber 16 until frontplate 4 and backplate 1 are in their desired locked engagement. In this configuration, spring 13 exerts expulsive force on the tip of pin 2 and on frontplate 4. Spring 13 remains compressed until the locking mechanism is released by an authorized user, at which point frontplate 4 is forced away from pin 2, and therefore from backplate 1. The subject safety lock thus falls away from the firearm and spring 13 returns to its expanded, relaxed position. Alternatively, the spring or a plurality of springs (for example, coil springs) could be affixed to backplate 1, for example, coiled around pin 2, such that upon engagement of backplate 1 to frontplate 4, the spring would be compressed, thereby exerting expulsive force against backplate 1 and frontplate 4.

In an alternative embodiment, spring 13 can be affixed to frontplate 4 in such a location as to be disposed on the inward-facing surface of frontplate 4 and so as to be in a relaxed position until backplate 1 and frontplate 4 are moved towards each other. As they are moved towards each other, spring 13 encounters the trigger guard of the firearm, and is compressed between the inward-facing surface of frontplate 4 and the trigger guard of the firearm as the backplate 1 and the frontplate 4 are engaged. Once backplate 1 and frontplate 4 are engaged and secured in the locked configuration, spring 13 exerts an expulsive force against both frontplate 4 and the trigger guard of the firearm. Spring 13 remains compressed until the locking mechanism is released by an authorized user, at which point frontplate 4 is forced away from the trigger guard of the firearm. The subject safety lock thus falls away from the firearm and spring 13 returns to its expanded, relaxed position. Other spring configurations will be readily apparent to the skilled artisan, and are clearly within the scope of the subject invention.

Figure 7:
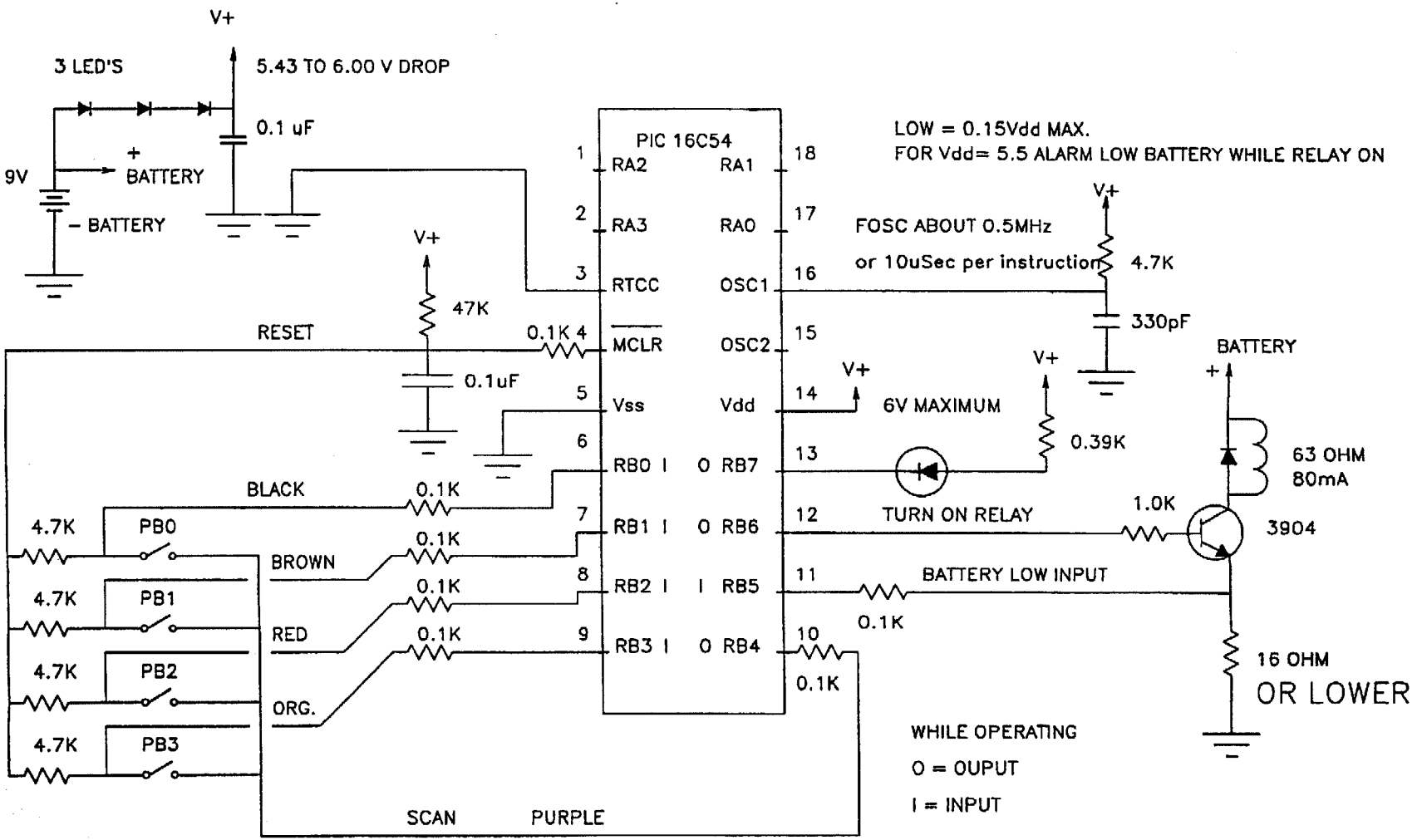
FIG. 7 is an electrical schematic diagram of a circuit usable for determining whether the correct code has been entered for operating the subject trigger lock.

Referring now to FIG. 7, this circuit is designed to minimize power consumption when the gun lock is not in use. The user will typically leave the gun lock in a drawer for days or months between uses, so the power supply and reset functions are optimized to reduce the draw of current when it is not in use. Note that several features are not shown but can easily be added to this design. For example:

an audible alarm can be driven by pins RA0, RA1, RA2, RA3 a back door power source could be provided through connections on the case so that battery failure would not prevent operation The center of the drawing is the CMOS integrated circuit, the PIC 16C54 microcontroller manufactured by MicroChip. The 9 volt battery power is reduced to approximately 5 volts by three small LED's in series. This novel feature was used to provide a power supply regulated below the 6 volt maximum allowable for the microcontroller. The power supply functions even at the 3 micro-ampere current used when the microcontroller is in sleep mode and thus extends the life of the battery considerably.

The 9 volt battery could, in an alternative embodiment, be replaced with two 1½ volt batteries to create a 3-volt system. In this embodiment, LED's would be removed. The coil would be one designed for low voltage operations (less than 3 volts) which types are well known in the art.

Note that the solenoid is fed directly from the battery and a 16 ohm resistor in series with the solenoid provides the LOW BATTERY INPUT to the microcontroller. The low input for this microcontroller is defined as below 0.15 of the voltage supplied to the chip. The power supply and the 16 ohm resistor in series with a 63 ohm coil provides a low battery indicator when the battery voltage drops below 7.5 volts. The indicator can be an LED or an audible alarm or both. This change of voltage level can be changed by selecting a different resistor.

The 0.1K resistors shown on all the input/output pins is part of the design to reduce the risk of damage to the CMOS from static electricity. These parts have no other function.

The TURN ON RELAY is the output pin that turns on the transistor that controls the solenoid current. The pin controls the general purpose indicator LED which is visible to the gun lock user indicating entry of an authorized code in the preferred embodiment of the subject invent/on.

The reset of the microcontroller is controlled by the MCLR pin which has the resistor and capacitor to control the time required to reset. Under normal operation the microcontroller has set RB4 (the SCAN line) low before going into sleep mode. During sleep mode the microcontroller memory is maintained, but the dock which runs on the OSC1 pin is shut down to save power. When any button is pressed the MCLR is pulled low and the microcontroller is reset. Please see the description to the Logic Drawing for the functions after reset.

After reset the SCAN line is made high to prevent another reset. The microcontroller polls the button status by pulling the SCAN line down for a few milliseconds and reading the inputs RB0 through RB3. Since the capacitor and resistor on MCLR provide about a 20 millisecond delay the microcontroller will not go into reset when the buttons are scanned. Note that in addition to instant response to a user pressing buttons that this configuration also minimizes power consumption when the gun lock is not being used.

Figure 8:
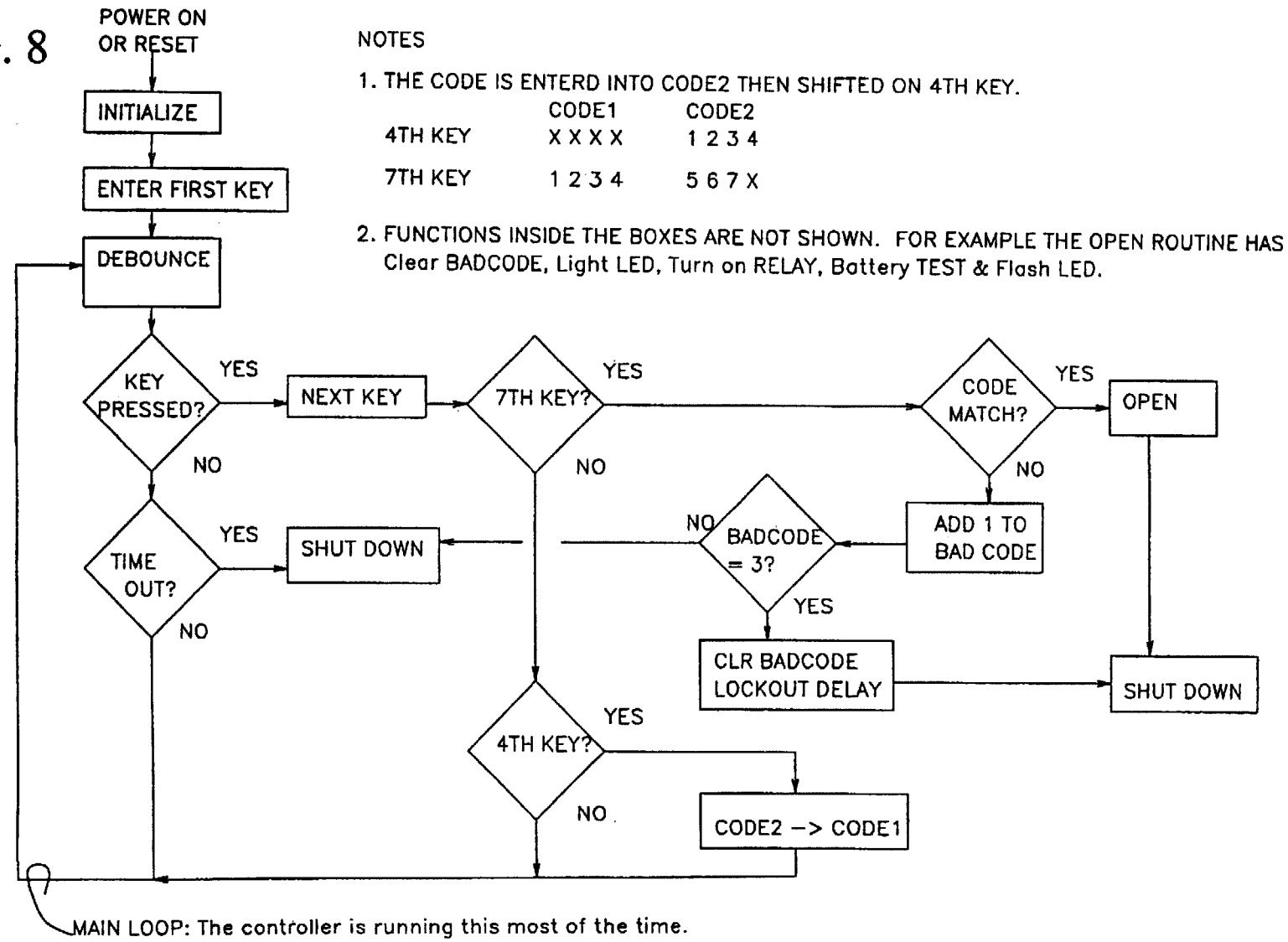
FIG. 8 is a schematic representation of a logic sequence suitable for analyzing whether the correct code has been entered for operation of the subject invention.

Referring now to FIG. 8, the intent of this design is to minimize power consumption while responding immediately when a user punches in a combination. The Logic Drawing illustrates the activity of the unit based on the software stored in the microcontroller.

The illustration is based on a lock using a seven button key, though keys could be of any length because this is a program on a microcontroller integrated circuit. The intention of the logic drawing is to show how the software in the microcontroller (mc) operates. The mc is reset on either power on (the insertion of a battery) or when any button is pressed while it is in SHUTDOWN.

First the mc initializes a set of registers and then it tries to enter the first key. Because of the speed of the mc the user will still have his finger on the first button when the INITIALIZE is complete. The addition of the battery causes a power on reset and the unit will sense that no button is pressed and continue on to the DEBOUNCE block.

DEBOUNCE is a set of routines to process the buttons states (pressed or not pressed) so that only key is entered for each time the user punches a button. The mc then moves on through two blocks, KEY PRESSED? and TIME OUT?, before again returning to DEBOUNCE. Whenever the unit is activated by pressing a button or installing a battery the mc spends almost all its time running through the three blocks DEBOUNCE, KEY PRESSED?, and TIME OUT? This is called the main loop.

When the next button is pressed the mc branches off the main loop to enter the NEXT KEY. The number of the button is saved and then the unit cheeks to see if enough keys have been entered to check the combination. In this particular illustration if seven keys have been entered the mc will see if there is a CODE MATCH? with the correct combination. If no button is pressed then the me will TIME OUT? and branch to the SHUT DOWN block. This block puts the mc in sleep mode and configures the inputs to reset when any button is pressed.

If a valid CODE MATCH? is obtained the mc will branch to the OPEN block and turn on the solenoid that opens the lock. In this same block the me will check for a low battery condition which is detected during solenoid operation because this is the highest current draw on the battery. For a low battery condition the mc will flash the LED to warn the user that the battery is not providing full voltage when a larger current is pulled from it. After about two seconds the mc branches to SHUTDOWN.

If an invalid CODE MATCH? is obtained then the mc will add one to register and check if this is the third bad code. On three bad codes the me will dear the bad code register and then LOCKOUT the unit by waiting some preset time period before shutting down. Note that this shutdown feature is one of the more important safety features in this design to prevent unauthorized use of the gun lock. During the LOCKOUT pressing the buttons will not reset the me or enter another code; the unit will be unresponsive to anything except interruption of the power supply. Additional software features can be easily added once a me is part of the design. For example:

- audio alarm signal upon entry of several incorrect codes (to prevent use of the lock by an unauthorized person)
- allow the user to program his own key when the device is first powered up
- driving the LED for different purposes including normal operation, imminent battery failure, indication of a lock out condition, etc.
- provision of a standard code (standard means all devices use an identical code) for putting the device in lock out mode for several hours. For example, children are visiting or the gun will be on public display at a convention. The user could enter 1234431 on his lock and it will remain locked for 8 hours. The only way to reset this condition would be to remove the battery, All of these features would either be impossible or impracticable without the use of a CMOS microcontroller.

Backplate 1 and frontplate 4 are preferably made from a hard, impervious material such as a polymer plastic which can be easily molded by injection molding or other techniques well-known in the art. A wide variety of suitable materials are known, which will be suitable for this purpose. Ideally, they will be suitable to withstand repeated blows without loss of structural integrity. Alternatively, the backplate and frontplate could be machined from a variety of suitable metal which are well-known in the art such as titanium or various types of stainless steel, among other metals.

The invention, in its broader aspects, is not limited to the specific details shown and described. Departures may be made from such details without departing from the principles of the invention. In view of the foregoing description there are many modifications and alternative embodiments of the subject invention which will immediately be obvious to those skilled in the art. Accordingly, the subject invention is defined and limited solely by the following claims.

We claim:

1. A safety lock for firearms comprising:

a backplate removably engageable with a frontplate when said backplate and said frontplate are applied to opposite sides of a trigger guard, said backplate and said frontplate each having an inward-facing surface and an outward-facing surface, said backplate further comprising:

a pin extending from said inward-facing surface of said backplate; and said frontplate further comprising:

a pin-receiving orifice opening to said inward-facing surface of said frontplate at a position strategically located to complementarily receive said pin when said backplate and said frontplate are operably positioned on opposite sides of the trigger guard, said pin-receiving orifice extending into said frontplate a sufficient distance to effectively receive said pin;

locking means functionally disposed within said frontplate such that in operation said locking means securely engages said pin;

means for receiving information whereby an authorized user of the safety lock can be identified; and electronically-powered means for analyzing the information to determine whether the information matches certain predetermined authorizing information, and if so, controlling the release of said locking means, wherein said locking means comprises a catch-plate comprising a rim which defines a pin-receiving aperture.

2. The safety lock of claim 1, wherein said pin comprises at least one tooth disposed on said pin such that when said backplate and said frontplate are in secured engagement, said tooth contacts said rim.

3. The safety lock of claim 2, wherein said pin comprises a plurality of teeth disposed on said pin, whereby a variety of trigger widths are accommodated.

4. The safety lock of claim 1 further comprising:

means for expulsion of said backplate from said frontplate upon release of said locking means.

5. The safety lock of claim 1 further comprising:

an external contact surface whereby an external battery can be applied to supply sufficient power to activate or deactivate said analyzing means.

6. The safety lock of claim 1 wherein said analyzing means, upon receipt of a predetermined amount of incorrect information or certain predetermined code information, controls the shutdown of the safety lock for a predetermined period of time.

7. The safety lock of claim 1 further comprising:

a shock sensor for detection of tampering.

8. The safety lock of claim 1 wherein said analyzing means, upon receipt of a predetermined amount of incorrect information or certain predetermined code information, controls the activation of a light-emitting diode.

9. A safety lock for firearms comprising:

a backplate removably engageable with a frontplate when said backplate and said frontplate are applied to opposite sides of a trigger guard, said backplate and said frontplate each having an inward-facing surface and an outward-facing surface, said backplate further comprising:

a pin extending from said inward-facing surface of said backplate; and said frontplate further comprising:

a pin-receiving orifice opening to said inward-facing surface of said frontplate at a position strategically located to complementarily receive said pin when said backplate and said frontplate are operably positioned on opposite sides of the trigger guard, said pin-receiving orifice extending into said frontplate a sufficient distance to effectively receive said pin;

locking means functionally disposed within said frontplate such that in operation said locking means securely engages said pin;

means for receiving information whereby an authorized user of the safety lock can be identified;

electronically-powered means for analyzing the information to determine whether the information matches certain predetermined authorizing information, and if so, controlling the release of said locking means; and means for expulsion of said backplate from said frontplate upon release of said locking means.

10. The safety lock of claim 9 wherein said means for expulsion comprises a spring means biased such that when said frontplate and said backplate are in secured engagement in operation, said spring means is deformed from its relaxed position.

11. The safety lock of claim 10, wherein said spring means, when deformed in operation, exerts expulsive force against said frontplate and said backplate.

12. The safety lock of claim 9 further comprising:

an external contact surface whereby an external battery can be applied to supply sufficient power to activate or deactivate said analyzing means.

13. The safety lock of claim 9 wherein said analyzing means, upon receipt of a predetermined amount of incorrect information or certain predetermined code information, controls the shutdown of the safety lock for a predetermined period of time.

14. The safety lock of claim B further comprising:

a shock sensor for detection of tampering.

15. The safety lock of claim 9 whereto said analyzing means, upon receipt of a predetermined amount of incorrect information or certain predetermined code information, controls the activation of a light-emitting diode.

16. A safety lock for firearms comprising:

a backplate removably engageable with a frontplate when said backplate and said frontplate are applied to opposite sides of a trigger guard, said backplate and said frontplate each having an inward-facing surface and an outward-facing surface, said backplate further comprising:

a pin extending from said inward-facing surface of said backplate; and said frontplate further comprising:

a pin-receiving orifice opening to said inward-facing surface of said frontplate at a position strategically located to complementarily receive said pin when said backplate and said frontplate are operably positioned on opposite sides of the trigger guard, said pin-receiving orifice extending into said frontplate a sufficient distance to effectively receive said pin;

locking means functionally disposed within said frontplate such that in operation said locking means securely engages said pin;

means for receiving information whereby an authorized user of the safety lock can be identified; and electronically-powered means for analyzing the information to determine whether the information matches certain predetermined authorizing information, and if so, controlling the release of said locking means, wherein said analyzing means, upon receipt of a predetermined amount of incorrect information or certain predetermined code information, controls the shutdown of the safety lock for a predetermined period of time.

17. The safety lock of claim 16 further comprising:

a shock sensor for detection of tampering.

18. The safety lock of claim 16 wherein said analyzing means, upon receipt of a predetermined amount of incorrect information or certain predetermined code information, controls the activation of a light-emitting diode.

19. A safety lock for firearms comprising:

a backplate removably engageable with a frontplate when said backplate and said frontplate are applied to opposite sides of a trigger guard, said backplate and said frontplate each having an inward-facing surface and an outward-facing surface, said backplate further comprising:

a pin extending from said inward-facing surface of said backplate; and said frontplate further comprising:

a pin-receiving orifice opening to said inward-facing surface of said frontplate at a position strategically located to complementarily receive said pin when said backplate and said frontplate are operably positioned on opposite sides of said trigger guard, said pin-receiving orifice extending into said frontplate a sufficient distance to effectively receive said pin;

locking means functionally disposed within said frontplate such that in operation said locking means securely engages said pin;

means for receiving information whereby an authorized user of the safety lock can be identified;

electronically-powered means for analyzing the information to determine whether the information matches certain predetermined authorizing information, and if so, controlling the release of said locking means; and an external contact surface whereby an external battery can be applied to supply sufficient power to activate or deactivate said analyzing means;

wherein said analyzing means, upon receipt of a predetermined amount of incorrect information or certain predetermined code information, controls the shutdown of the safety lock for a predetermined period of time.

20. A safety lock for firearms comprising:

a backplate removably engageable with a frontplate when said backplate and said frontplate are applied to opposite sides of a trigger guard, said backplate and said frontplate each having an inward-facing surface and an outward-facing surface, said backplate further comprising:

a pin extending from said inward-facing surface of said backplate; and said frontplate further comprising:

a pin-receiving orifice opening to said inward-facing surface of said frontplate at a position strategically located to complementarily receive said pin when said backplate and said frontplate are operably positioned on opposite sides of said trigger guard, said pin-receiving orifice extending into said frontplate a sufficient distance to effectively receive said pin;

locking means functionally disposed within said frontplate such that in operation said locking means securely engages said pin;

means for receiving information whereby an authorized user of the safety lock can be identified;

electronically-powered means for analyzing the information to determine whether the information matches certain predetermined authorizing information, and if so, controlling the release of said locking means; and an external contact surface whereby an external battery can be applied to supply sufficient power to activate or deactivate said analyzing means;

wherein said analyzing means, upon receipt of a predetermined amount of incorrect information or certain predetermined code information, controls the activation of a light-emitting diode.

21. A safety lock for firearms comprising:

a backplate removably engageable with a frontplate when said backplate and said frontplate are applied to opposite sides of a trigger guard, said backplate and said frontplate each having an inward-facing surface and an outward-facing surface, said backplate further comprising:

a pin extending from said inward-facing surface of said backplate; and said frontplate further comprising:

a pin-receiving orifice opening to said inward-facing surface of said frontplate at a position strategically located to complementarily receive said pin when said backplate and said frontplate are operably positioned on opposite sides of said trigger guard, said pin-receiving orifice extending into said frontplate a sufficient distance to effectively receive said pin;

locking means functionally disposed within said frontplate such that in operation said locking means securely engages said pin;

means for receiving information whereby an authorized user of the safety lock can be identified;

electronically-powered means for analyzing the information to determine whether the information matches certain predetermined authorizing information, and if so, controlling the release of said locking means; and sensor means for detection of tampering, said tampering being excessive vibration, shock, or prying force applied to said lock;

wherein said analyzing means, upon receipt of a predetermined amount of incorrect information or certain predetermined code information, controls the activation of a light-emitting diode.

* * * * *

UNITED STATES PATENT AND TRADEMARK OFFICE

CERTIFICATE OF CORRECTION

PATENT NO. : 5,704,151

DATED : January 1, 1998

INVENTOR(S) : James Paul West, et al

It is certified that error appears in the above-indentified patent and that said Letters Patent is hereby corrected as shown below:

Column 4, line 1: "that .operates" should read --that operates--;

line 37: "to a, reliable" should read --to a reliable--;

line 38: "pin 2i..s" should read --pin 2 is--; and line 40: "12,, and" should read --12, and--.

Column 7, line 20: "invent/on." should read --invention--; and line 26: "dock" should read --clock--.

Column 8, line 5: "me" should read --mc--;

line 11: "me" should read --mc--;

line 20: "me will dear" should read --mc will clear--;

line 25: "me" should read --mc--; and line 28: "me" should read --mc--.

UNITED STATES PATENT AND TRADEMARK OFFICE

CERTIFICATE OF CORRECTION

PATENT NO. : 5,704,151

DATED : January 1, 1998

INVENTOR(S) : James Paul West, et al

It is certified that error appears in the above-indentified patent and that said Letters Patent is hereby corrected as shown below:

Column 10, line 33 (Claim 14): "of claim B" should read --of claim 9--.

line 35 (Claim 15): "whereto" should read --wherein--.

Signed and Sealed this

Twenty-first Day of July, 1998

*Attest:*

*Attesting Officer*

BRUCE LEHMAN

*Commissioner of Patents and Trademarks*